US009155947B2

(12) United States Patent
Aguinaldo et al.

(10) Patent No.: US 9,155,947 B2
(45) **Date of Patent: *Oct. 13, 2015**

(54) VARIABLE LENGTH SHAFT AND GRIP

(71) Applicant: CALLAWAY GOLF COMPANY, Carlsbad, CA (US)

(72) Inventors: Homer E. Aguinaldo, Chula Vista, CA (US); Tim Goudarzi, San Marcos, CA (US)

(73) Assignee: CALLAWAY GOLF COMPANY, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/339,832

(22) Filed: Jul. 24, 2014

(65) Prior Publication Data

US 2014/0335966 A1 Nov. 13, 2014

Related U.S. Application Data

(63) Continuation of application No. 13/742,060, filed on Jan. 15, 2013, now Pat. No. 8,834,288.

(60) Provisional application No. 61/721,348, filed on Nov. 1, 2012.

(51) Int. Cl.

| | |
|---|---|
| ***A63B 53/16*** | (2006.01) |
| ***A63B 53/10*** | (2015.01) |
| ***A63B 59/00*** | (2015.01) |
| *A63B 71/06* | (2006.01) |

(52) U.S. Cl.

CPC ..... *A63B 53/10* (2013.01); *A63B 53/16* (2013.01); *A63B 59/0044* (2013.01); *A63B 2059/0085* (2013.01); *A63B 2071/0694* (2013.01); *Y10T 403/32467* (2015.01); *Y10T 403/32516* (2015.01)

(58) Field of Classification Search

CPC ..... A63B 53/10; A63B 53/16; A63B 59/044; A63B 2071/0694; A63B 2059/0885; Y10T 403/32516; Y10T 403/32467

See application file for complete search history.

(56) References Cited

U.S. PATENT DOCUMENTS

| | | | | | |
|---|---|---|---|---|---|
| 1,648,806 | A * | 11/1927 | Hadden | A63B 53/16 | 473/296 |
| 1,943,066 | A * | 1/1934 | Ford | A63B 53/06 | 280/823 |
| 3,539,185 | A * | 11/1970 | Andis | A63B 53/16 | 16/429 |
| 4,461,057 | A * | 7/1984 | Unger | B25G 1/04 | 16/422 |
| 5,496,029 | A * | 3/1996 | Heath | A63B 53/10 | 473/296 |
| 7,326,222 | B2 * | 2/2008 | Dreyfuss | A61B 17/0469 | 606/103 |
| 8,328,657 | B1 * | 12/2012 | Demkowski | A63B 53/16 | 473/239 |

(Continued)

*Primary Examiner* — Stephen Blau

(74) *Attorney, Agent, or Firm* — Rebecca Hanovice; Michael A. Catania; Sonia Lari

(57) ABSTRACT

A variable length shaft assembly comprising a shaft, a shaft adapter, a grip sleeve, an actuator screw, a grip, and a screw is disclosed herein. The grip is bonded to the grip sleeve, the shaft adapter is bonded to the shaft, and the shaft adapter comprises a keyed portion that mates with a keyed structure inside of the grip sleeve. The actuator screw comprises external threads that mate with internal threads inside the grip sleeve, and the location of the actuator screw within the grip sleeve can be adjusted with a wrench. Once the actuator screw is at a desired location within the grip sleeve, the shaft is semi-permanently fixed to the grip sleeve by releasably affixing the keyed structure of the shaft adapter to the actuator screw with the screw. The overall length of the assembly can be adjusted and fine-tuned using these structures.

19 Claims, 8 Drawing Sheets

(56) References Cited

U.S. PATENT DOCUMENTS 8,491,408 B2 * 7/2013 Beach ..... A63B 53/10
473/296
8,747,247 B2 * 6/2014 Beach ..... A63B 53/10
403/109.5
8,758,155 B1 * 6/2014 Demkowski ..... A63B 53/16
473/296
2009/0270197 A1 * 10/2009 Holtzman ..... A63B 53/007
473/296
2013/0304042 A1 * 11/2013 Ryll ..... A61B 17/29
606/1
2014/0171214 A1 * 6/2014 Wall, Jr. ..... A63B 53/10
473/296

* cited by examiner

VARIABLE LENGTH SHAFT AND GRIP

CROSS REFERENCES TO RELATED APPLICATIONS

The present application is a continuation of U.S. patent application Ser. No. 13/742,060, filed on Jan. 15, 2013, which claims priority to U.S. Provisional Patent Application No. 61/721,348, filed on Nov. 1, 2012, the disclosure of each of which is hereby incorporated by reference in its entirety herein.

STATEMENT REGARDING FEDERALLY SPONSORED RESEARCH OR DEVELOPMENT

None

BACKGROUND OF THE INVENTION

1. Field of the Invention

The present invention relates to a variable length shaft assembly that allows for quick, semi-permanent length adjustments. More specifically, the present invention relates to a variable length shaft that conforms to USGA rules, and whose length can be adjusted without the use of multiple shaft extension components.

2. Description of the Related Art

Customization of golf clubs to help golfers attain better shots has become a popular and more prevalent practice in recent years. Golf club manufacturers and designers have devised various features to allow club fitters and golf club players to adjust certain characteristics of their clubs. Such characteristics include loft, lie, face angle, center of gravity (CG) location, and club length.

Current technology provides two methods to adjust overall club length. One such method involves the destruction and removal of the grip on a shaft. Upon removal of the grip by peeling or tearing, the end portion of the shaft is trimmed to decrease the club length or an extension piece is affixed to the end of the shaft to increase its length. Aftermarket extensions are available specifically for this purpose; alternatively, extensions can be made from portions of other golf club shafts that are cut to the desired length and then inserted into the end of the first club's shaft. The extension piece must match the diameter of the existing shaft, so it is necessary at times to build up the diameter of the extension or existing shaft by adding layers of tape. This method requires that the user making the adjustments have access to potentially expensive new components and tools as well as having a high level of skill. It also causes damage to the original shaft and grip.

The second method of adjusting club length involves replacing the entire shaft and grip using a semi-permanent head-shaft connection device that some manufacturers offer with their clubs, particularly with drivers. The existing shaft may be removed from the driver head and replaced with a different shaft that has either a shorter or longer length. This method is not possible on all clubs, however, as the head must have hardware that allows for removal of the shaft and replacement with a new shaft without damaging the head.

A golfer who does not possess club altering skills or the necessary disposable income to purchase new components likely will be daunted by these two methods of adjusting club length. The first method requires the golfer to make use of several tools to remove the grip and cut the shaft if he or she desires a shorter length, and also to have materials such as tape and a replacement grip on hand to replace the grip and mend any damage caused to the shaft and grip. The skill set required to change the shaft length using this method is usually beyond the abilities of the average golfer, so the golfer would need to seek the services of a golf club fitter or technician to have their club length changed. The second method requires the golfer to buy an entirely new shaft at a different length, which can be very expensive, and also may require the golfer to retain a golf club fitter or technician to replace the shaft.

Ultimately, the two methods described above require an inventory of spare components and above average technical skill, particularly with regard to the first method. It is therefore desirable to facilitate the change of a club's length using a faster, easier, and less expensive system and method than is currently available.

BRIEF SUMMARY OF THE INVENTION

One aspect of the present invention is a shaft assembly comprising a first shaft comprising an internal surface, a second shaft, a mechanical fastener, and an actuator screw comprising a threaded external surface, a first cavity, and a through-bore sized to receive at least part of the mechanical fastener, wherein the second shaft comprises a tip end sized to fit within the first cavity and a first keyed structure, wherein the internal surface comprises threads and a second keyed structure sized to mate with the first keyed structure, wherein the threaded external surface of the actuator screw mates with the threads on the internal surface of the first shaft, and wherein fixing the actuator screw to the tip end with the mechanical fastener releasably affixes the first shaft to the second shaft. In some embodiments, the mechanical fastener may be a screw having a head and a threaded portion, and the tip end may comprise a threaded bore sized to receive the threaded portion of the mechanical fastener. In other embodiments, the actuator screw may comprise a second cavity sized to mate with an adjustment tool. In one embodiment, the second shaft may comprise an unthreaded external surface, which may comprise length markings. In other embodiments, the grip may be disposed on an external surface of the first shaft.

Another aspect of the present invention is a variable length shaft assembly comprising a shaft, a shaft adapter, and a grip sleeve, wherein the grip sleeve comprises a threaded internal surface, wherein the shaft adapter comprises a threaded external surface sized to engage with the threaded internal surface of the grip sleeve, and wherein the shaft adapter is affixed to the shaft. In some embodiments, the shaft adapter may comprise an adapter portion and an actuator screw portion, the threaded external surface may be disposed on the actuator screw portion, and the actuator screw portion may be releasably attached to the adapter portion. In some embodiments, the shaft assembly may further comprise a mechanical fastener, and attaching the actuator screw portion to the adapter portion with the mechanical fastener may fix the shaft adapter to the grip sleeve. In further embodiments, the mechanical fastener may be a screw comprising a head and a threaded extension, and the screw may reversibly fix the shaft adapter to the grip sleeve. In other embodiments, the adapter portion may comprise a first keyed structure, the grip sleeve may comprise a second keyed structure, and the first keyed structure may mate with the second keyed structure to prevent the shaft adapter from rotating when the adapter portion is inserted into the grip sleeve.

In other embodiments, the shaft assembly may further comprise a retention o-ring, the actuator screw portion may comprise a flange having a through bore, the threaded extension of the screw may be disposed within the through bore, and the retention o-ring may prevent the screw from disengaging from the actuator screw. In some embodiments, the shaft may comprise an external surface having a plurality of length markings, the grip sleeve may comprise a grip portion composed of a rubber material, and the shaft adapter may be permanently affixed to the shaft.

Yet another aspect of the present invention is a variable length golf club comprising a golf club head, a shaft comprising a through bore and an external surface, a grip sleeve comprising a through bore, a receiving section, and a body, a shaft adapter comprising a base, a keyed extension, and a tip portion, an actuator screw comprising a first cavity, a second cavity, a flange having a through bore, and a threaded external surface, a mechanical fastener, and a grip, wherein a first end of the shaft is affixed to the golf club head, wherein the base of the shaft adapter is permanently affixed to second end of the shaft, wherein the grip is affixed to an external surface of the body of the grip sleeve, wherein each of the actuator screw, the keyed extension, and the tip portion is sized to fit within the body of the grip sleeve, wherein the body of the grip sleeve comprises a threaded internal surface sized to engage with the threaded external surface of the actuator screw and an internal keyed geometry sized to mate with the keyed extension of the shaft adapter, wherein the tip portion fits within the second cavity of the actuator screw, and wherein the mechanical fastener releasably affixes the actuator screw to the tip portion of the shaft adapter.

In some embodiments, the variable length golf club may be capable of increasing and decreasing in length by at least 0.50 inch. In other embodiments, the receiving section of the grip sleeve may have a first diameter sized to receive the entire shaft adapter and the shaft, and the body of the grip sleeve may have a second diameter sized to receive the keyed extension and the tip portion of the shaft adapter but not the shaft. In still other embodiments, the mechanical fastener may be a screw comprising a head and a threaded extension, the tip portion of the shaft adapter may comprise a threaded bore sized to receive the threaded extension of the screw, and the threaded bore in the tip portion of the shaft adapter may align with the through bore in the flange of the actuator screw when the tip portion is disposed within the second cavity of the actuator screw.

In further embodiments, the variable length golf club may further comprise a retention o-ring, the threaded extension of the screw may extend through the through bore in the flange of the actuator screw, and the retention o-ring may prevent the screw from disengaging from the actuator screw. In some embodiments, the first cavity of the actuator screw may comprise a keyed geometry sized to mate with an adjustment tool, and the actuator screw may be disposed at any point along the threaded internal surface of the body of the grip sleeve. In further embodiments, the keyed geometry of the first cavity of the actuator screw may comprise a hexagonal structure, and each of the keyed extension of the shaft adapter and the internal keyed geometry of the grip sleeve body may comprise an octagonal structure. In still other embodiments, the grip sleeve, the shaft adapter, and the shaft may be composed of a composite material, the actuator screw may be composed of a plastic material, the screw may be composed of a metal alloy material, the grip may be composed of a polymeric material, and the external surface of the shaft may comprise a plurality of length markings.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
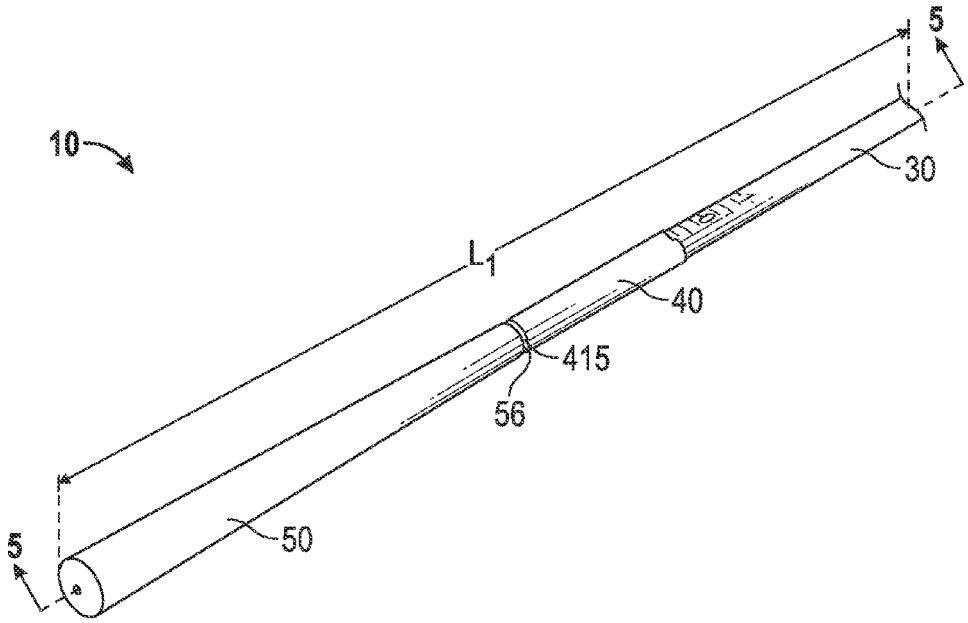
FIG. 1 is a side perspective view of a first embodiment of the invention in assembled form.

The present invention is directed to a variable length shaft that provides club length adjustability. Club length adjustability is an advantageous feature for golf clubs because, for example, extending the length of a club can have the desired effect of increasing club head speed, which results in longer driving distances. Conversely, shortening the length of a club can provide a golfer with more control and accuracy in driving the golf ball. Golf course conditions often require accurate driving due to hazards, including but not limited to water, rough, and out of bounds markers, and driving accuracy can be more preferred than driving distance in competitive situations.

The present invention is also valuable because a golfer's swing may change over time, thus requiring alterations to his or her clubs. A golfer may improve his or her game through lessons and may gain greater flexibility and strength through practice and exercise. As such, it is reasonable for a golfer to wish to change his or her club's shaft and/or grip length to help improve his or her accuracy, distance, and feel as needed or desired.

The present invention provides golfers with a system and method to easily, quickly and inexpensively modify the length of their golf club shafts and/or grips to have them perform in a desired manner. This invention enables golfers to change their club length wherever they wish, including, but not limited to, at the practice range, the golf course, and their home. The present invention also is designed to avoid altering a club's swing weight or its "feel." The tool and components that are used to alter a club's length are small and can be carried in a pocket of the user's golf bag. Furthermore, the technical ability required to modify the golf club length according to this invention is minimal and its approach is intuitive and easy for a golfer to understand. The present adjustable shaft invention can be used with any golf club head, including driver, putter, and iron heads, and may also be used with any type of equipment or structure (including, but not limited to, sporting equipment) that could benefit from a variable-length shaft.

A preferred embodiment of the present variable length shaft and grip system 10 is shown in FIGS. 1-8E, and comprises a shaft adapter 20, a shaft 30, a grip sleeve 40, a grip 50, an actuator screw 60, a screw 70 having a head 72 and a threaded extension 74, and an o-ring 90. In alternative embodiments, the screw 70 may be replaced with any type of mechanical fastener known to a person skilled in the art. Still other embodiments may not include the o-ring 90.

Figure 3:
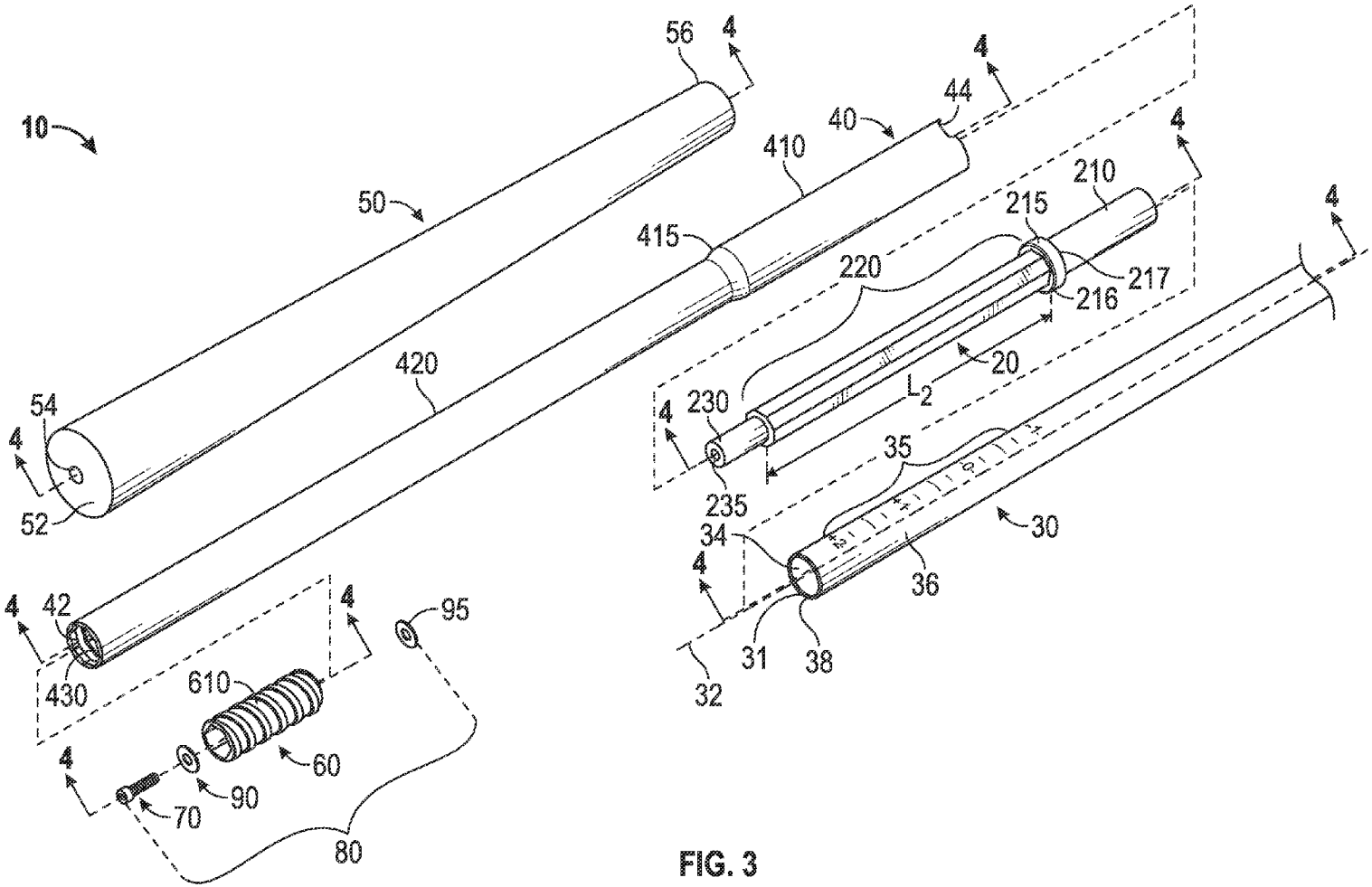
FIG. 3 is a side perspective view of the embodiment shown in FIG. 1 in exploded form.

As shown in FIG. 3, the shaft 30 preferably has a first end 31, a second end (not shown) that is bonded to a golf club head (not shown), a through bore 34, and length markings 35. The length markings 35 preferably are disposed on an external surface 36 of the shaft 30 proximate the first end 31 to assist a user when he or she wishes to precisely adjust the length of the golf shaft and/or grip along a shaft axis 32. The length markings 35 may be engraved into the shaft 30 or may be applied via paint or a decal. The shaft 30 preferably is composed of a thin, lightweight, sturdy composite material, but in alternative embodiments may be composed of plastic or a metal alloy, or any other material known to a person skilled in the art. In other embodiments, the shaft may have only a partial bore that does not extend all the way from the first end 31 to the second end, but instead is sized only to receive the base 210 of the shaft adapter 20.

Figure 4:
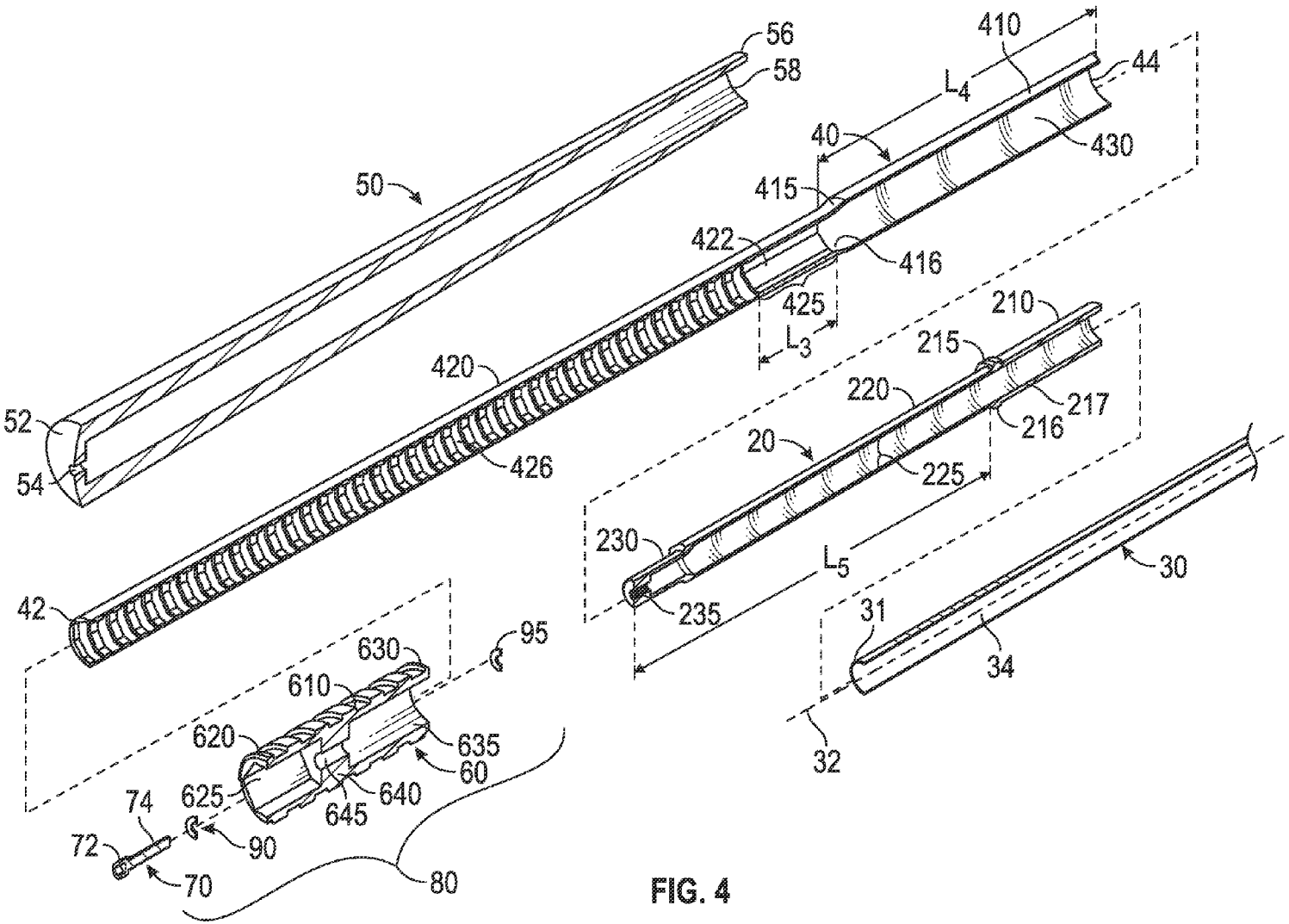
FIG. 4 is a cross-sectional view of the embodiment shown in FIG. 3 along lines 4-4.
Figure 7A:
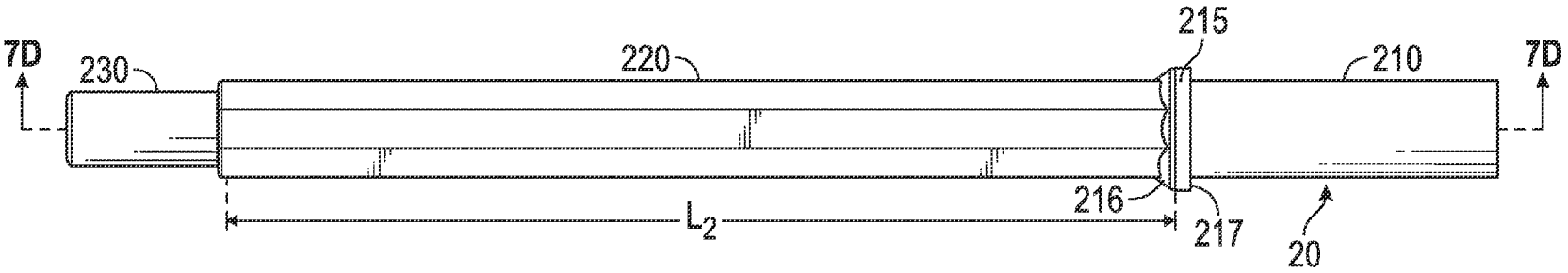
FIG. 7A is a side perspective view of the shaft adapter of the first embodiment shown in FIG. 1.
Figure 7C:
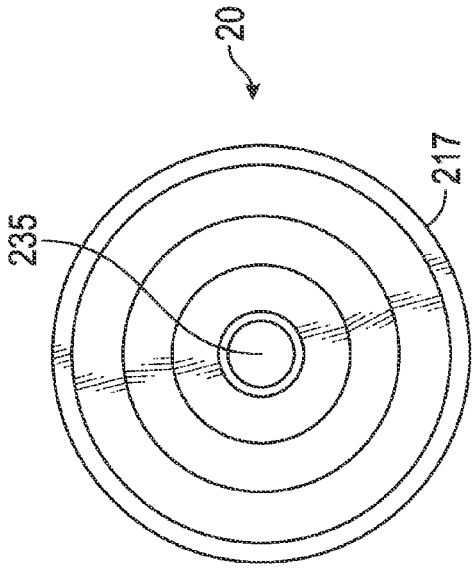
FIG. 7C is a bottom plan view of the shaft adapter shown in FIG. 7A.
Figure 7B:
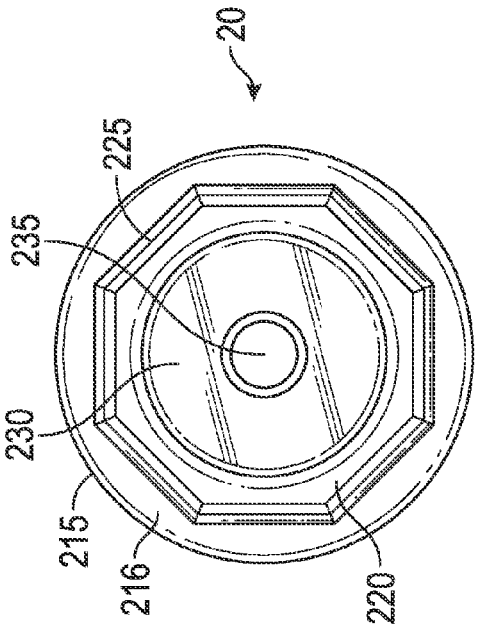
FIG. 7B is a top plan view of the shaft adapter shown in FIG. 7A.
Figure 7D:
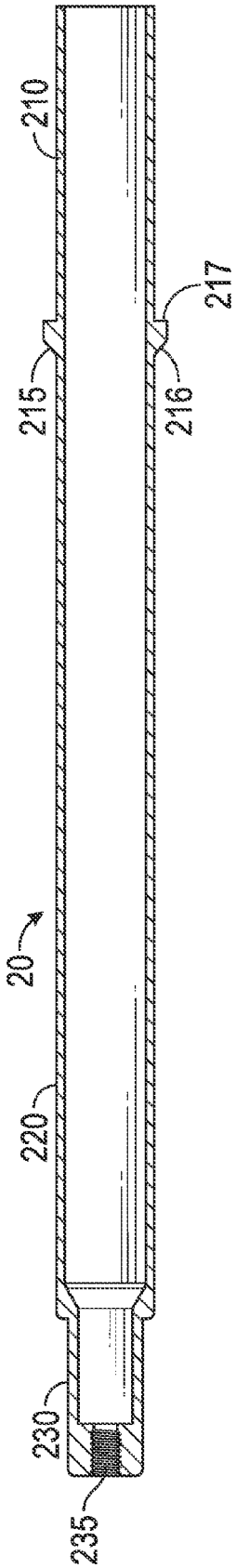
FIG. 7D is a cross-sectional view of the shaft adapter shown in FIG. 7A along lines 7D-7D.

As shown in FIGS. 3-5 and 7A-7D, the shaft adapter 20 comprises a base 210, a keyed extension 220, and a tip portion 230. The base 210 is sized to fit snugly within the first end 31 of the shaft 30, and preferably is permanently affixed to the shaft 30 with a permanent adhesive, one or more mechanical fasteners, or any other means known to a person skilled in the art. In alternative embodiments, the base 210 may be affixed to an external surface 36 or an edge surface 38 of the shaft 30. The shaft adapter 20 may be sized to fit into any desired shaft, so that an otherwise non-adjustable shaft 30 may be retrofitted to benefit from the variable length shaft and grip system 10 disclosed herein. The shaft adapter 20 preferably is hollow, as shown in FIGS. 4 and 7D, and preferably is composed of a lightweight composite material, though in alternative embodiments the shaft adapter 20 may be composed of plastic, metal alloy, or any other material preferred by a person skilled in the art, and may be partially or completely solid.

The keyed extension 220 extends longitudinally from the base 210, and in the preferred embodiment has an octagonal external geometry 225 that mates with an octagonal internal keyed geometry 422 of the grip sleeve 40 and prevents the shaft adapter 20, and thus the shaft 30, from rotating when the shaft adapter 20 is disposed within the grip sleeve 40. In alternative embodiments, however, the keyed extension 220 may have any cross-sectional shape that, when mating with a corresponding shape within the grip sleeve 40, prevents rotation of the shaft adapter 20 within the grip sleeve 40. The tip portion 230 extends longitudinally from the keyed extension 220 and includes a threaded bore 235 sized to receive the threaded extension 74 of the screw 70. In the preferred embodiment, the tip portion 230 has a cylindrical shape, and has a smaller diameter than that of the keyed extension 220 and the base 210. As shown in FIGS. 5 and 7A-7D, the base 210 is divided from the keyed extension 220 with a raised ring 215, which creates a first ledge 216 that serves to prevent the base 210 of the shaft adapter 20 from moving too far within the grip sleeve 40 and a second ledge 217 against which the edge surface 38 of the shaft 30 abuts. The shaft adapter 20 may have any length desired by the user, and preferably allows the variable length shaft and grip system 10 to increase and/or decrease in length by at least 1 inch.

Figure 5:
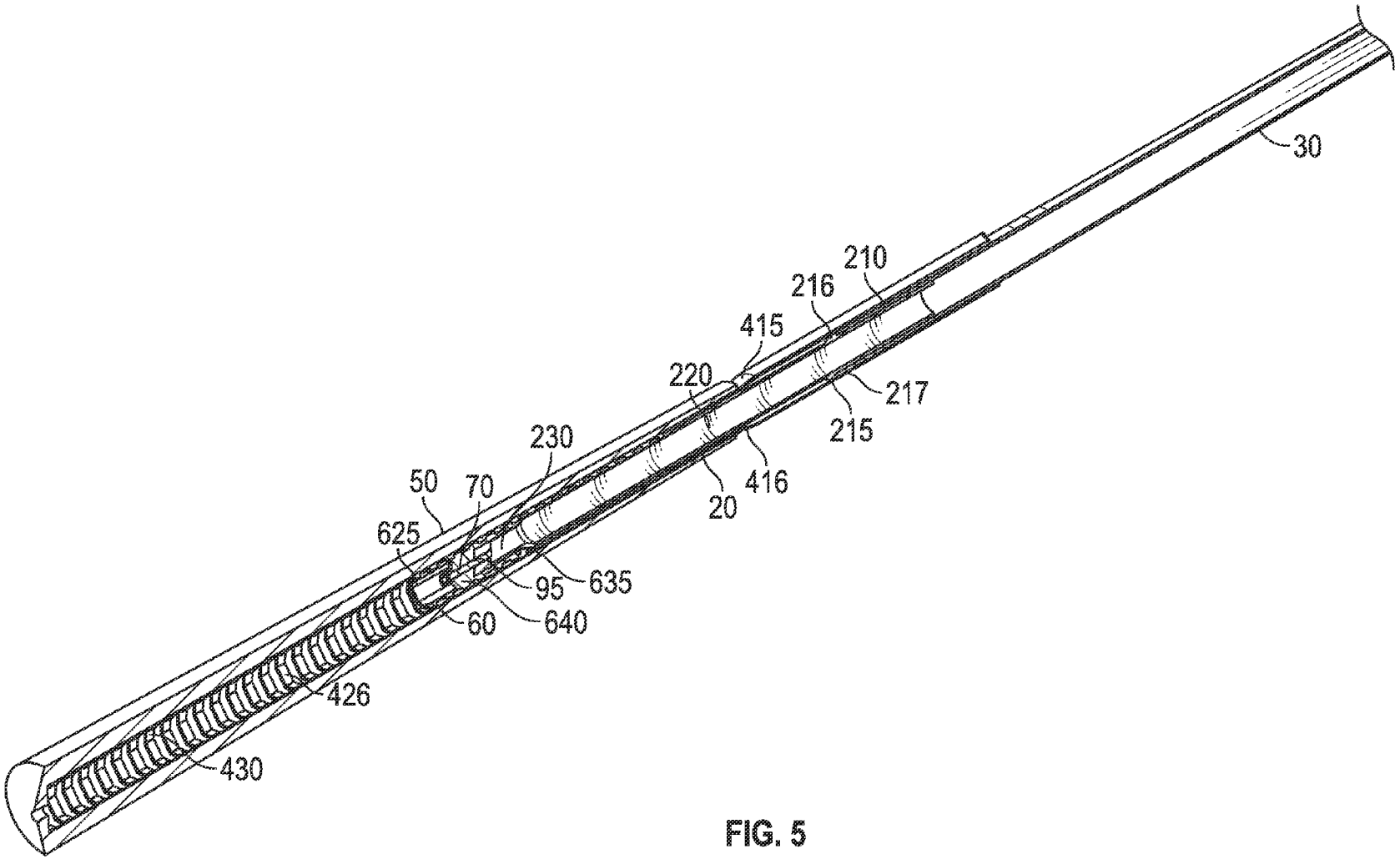
FIG. 5 is a cross-sectional view of the embodiment shown in FIG. 1 along lines 5-5.
Figure 6A:
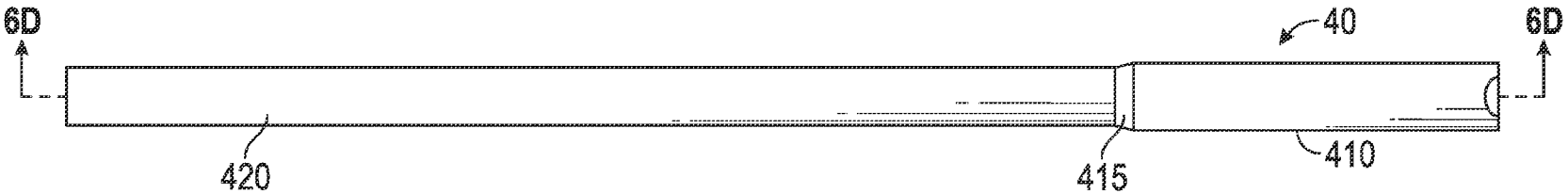
FIG. 6A is a side perspective view of the grip sleeve of the first embodiment shown in FIG. 1.
Figure 6C:
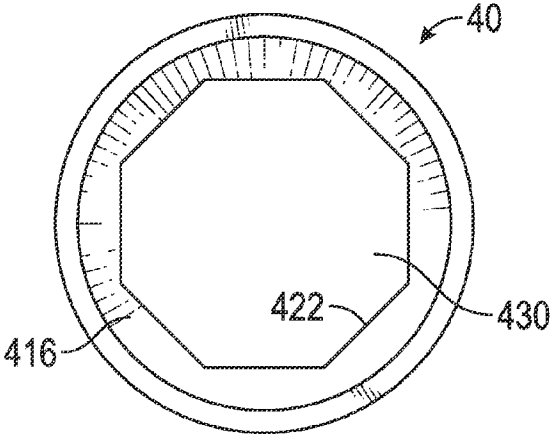
FIG. 6C is a bottom plan view of the grip sleeve shown in FIG. 6A.
Figure 6B:
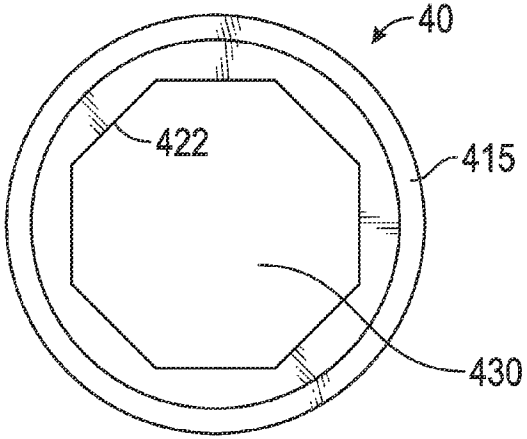
FIG. 6B is a top plan view of the grip sleeve shown in FIG. 6A.
Figure 6D:
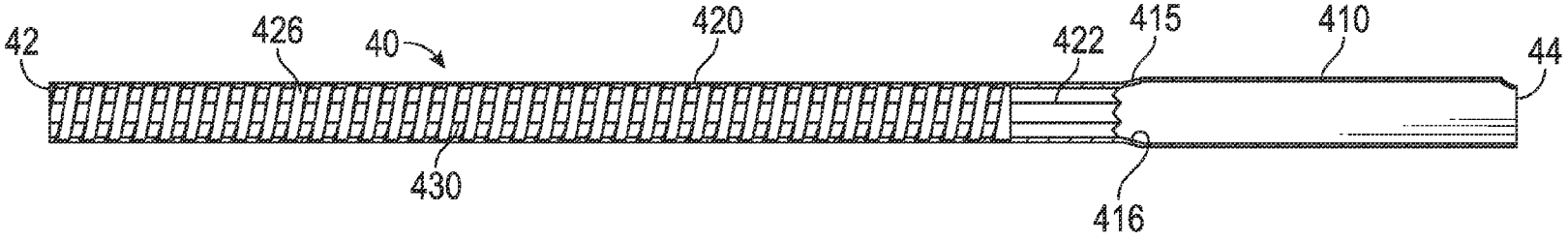
FIG. 6D is a cross-sectional view of the grip sleeve shown in FIG. 6A along lines 6D-6D.

As shown in FIGS. 1-6D, the grip sleeve 40 comprises a receiving section 410, which, as shown in FIG. 5, is sized to receive both the shaft adapter 20 and the shaft 30, and a body 420, which comprises an internal keyed geometry 422 and a threaded internal surface 426 with threads having a pitch of approximately 0.125-0.500 inch, more preferably 0.20-0.30 inch, and most preferably 0.25 inch. As noted herein, the internal keyed geometry 422 preferably is octagonal, and is sized to mate with the octagonal external geometry 225 of the keyed extension 220. In other embodiments, however, the internal keyed geometry 422 may have any cross-sectional shape that, when mating with a corresponding shape on the keyed extension 220, prevents rotation of the shaft adapter 20 within the grip sleeve 40. For example, the internal keyed geometry 422 of the grip sleeve 40 and the external geometry 225 of the shaft adapter 20 may include splines, projections, different polygonal shapes, or other mating features known to a person skilled in the art.

As shown in FIGS. 3-6A and 6D, the receiving section 410 has a larger diameter than the body 420, and the point at which the receiving section 410 intersects with the body 420 forms a first, exterior ledge 415 and a second, interior ledge 416. The grip sleeve 40 is hollow and has a through bore 430 that extends from a first end 42 to a second end 44 at the mouth of the receiving section 410, and preferably is composed of a lightweight composite material, though in alternative embodiments the grip sleeve 40 may be composed of plastic, metal alloy, or any other material preferred by a person skilled in the art.

Figure 2:
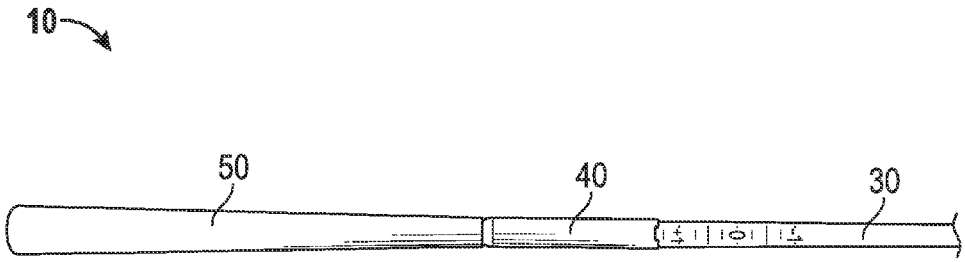
FIG. 2 is another side perspective view of the embodiment shown in FIG. 1.

The preferred embodiment of the present invention also includes a grip 50, shown in FIGS. 1-5, which is hollow and is sized to fit over the body 420 of the grip sleeve 40. As shown in FIGS. 3 and 4, the grip 50 comprises a top end 52 with an opening 54 that is large enough to give an adjustment tool (not shown) access to the interior structure of the variable length shaft and grip system 10, and a bottom end 56 with an opening 58 sized to receive the body 420 of the grip sleeve 40. In the preferred embodiment, the grip 50 is permanently affixed to the external surface of the grip sleeve 40 body 420 with an adhesive, and the bottom end 56 of the grip 50 abuts the first, exterior ledge 415 of the grip sleeve 40 as shown in FIGS. 1, 2, and 5. In embodiments in which the variable length shaft and grip system 10 disclosed herein is not used in connection with sporting goods or a structure that requires a grip, the grip 50 need not be used. The grip 50 is preferably composed of a rubber material, but in other embodiments may be composed of any material and have any characteristics, such as elasticity, thickness, and length, known to a person skilled in the art.

The actuator screw 60 of the present invention provides the releasable locking and adjustment mechanism for the variable length shaft and grip system 10 disclosed herein. As shown in FIGS. 3-5 and 8A-8E, the actuator screw 60 is a tubular structure with a consistent external diameter that is sized to fit within the body 420 of the grip sleeve 40. The actuator screw 60 has a threaded external surface 610, a first end 620 with a first cavity 625, a second end 630 with a second cavity 635, and a flange 640 disposed between the first and second cavities 625, 635 with a through bore 645 sized to receive the threaded extension 74 of the screw 70. The threads on the threaded external surface 610 preferably have a pitch that matches the pitch of the threads of the threaded internal surface 426, (approximately 0.125-0.500 inch, more preferably 0.20-0.30 inch, and most preferably 0.25 inch), and preferably allow for 0.25 inch of length adjustment per turn of the actuator screw 60 within the grip sleeve 40 body 420. As shown in FIG. 5, the o-ring 90 sits within the first cavity 625 and abuts the flange 640, cushioning the head 72 of the screw 70 when the threaded extension 74 is fully threaded through the through bore 645.

Figure 8A:
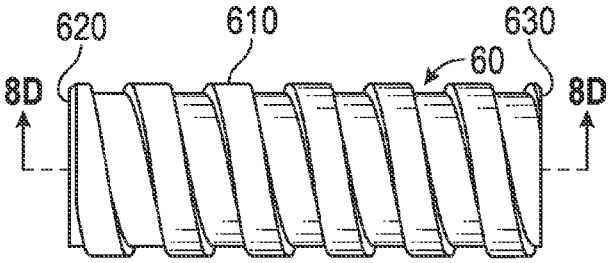
FIG. 8A is a side perspective view of the actuator screw of the first embodiment of the present invention shown in FIG. 1.
Figure 8B:
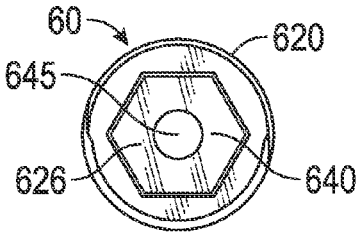
FIG. 8B is a top plan view of the actuator screw shown in FIG. 8A.
Figure 8C:
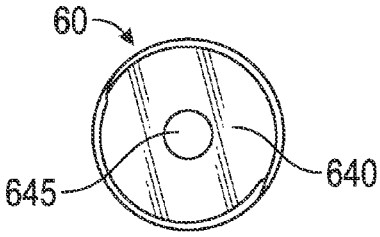
FIG. 8C is a bottom plan view of the actuator screw shown in FIG. 8A.
Figure 8D:
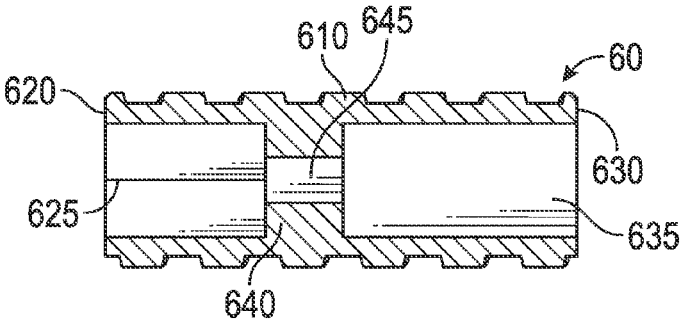
FIG. 8D is a cross-sectional view of the actuator screw shown in FIG. 8A along lines 8D-8D.
Figure 8E:
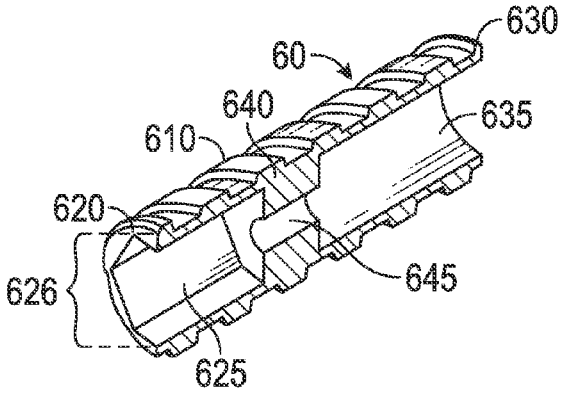
FIG. 8E is a side perspective view of the cross-sectional view shown in FIG. 8D.

As shown in FIGS. 8D and 8E, the first cavity 625 of the actuator screw 60 has a hexagonal internal geometry 626 which is sized to mate with a hex wrench (not shown), while the second cavity 635 has a cylindrical internal geometry sized to receive the tip portion 230 of the shaft adapter 20. As shown in FIG. 5, the through bore 645 is located within the actuator screw 60 to line up with the threaded bore 235 in the tip portion 230 of the shaft adapter 20 when the tip portion 230 is disposed within the second cavity 635. In alternate embodiments, the first cavity 625 may have any type of structural configuration that receives a wrench or other tool having mating geometry.

In the preferred embodiment, the o-ring 90 and the screw 70 are inserted into the first cavity 625 of the actuator screw 60 such that the o-ring 90 is disposed between the screw head 72 and the flange 640. The screw 70 preferably is prevented from becoming disengaged from the actuator screw 60 with a second, retention o-ring 95 that is affixed to the tail end of the threaded extension 74 of the screw 70 so that the flange 640 is trapped between the screw head 72, which cannot fit through the through bore 645, and the retention o-ring 95. In alternative embodiments, a clip may be attached to the threaded extension 74, or any other means known to a person skilled in the art to prevent the screw 70 from disengaging from the actuator screw 60.

Once the actuator screw 60 is assembled with the o-ring 90, screw 70, and retention o-ring 95 as described, this assembly 80 is inserted into the body 420 of the grip sleeve 40 such that the threaded external surface 610 mates with the threaded internal surface 426 of the grip sleeve 40. The actuator screw 60 may be inserted into either end 42, 44 of the grip sleeve 40, but preferably is inserted into the first end 42 where the threaded internal surface 426 begins. The grip 50 may then be bonded to the exterior surface of the body 420 of the grip sleeve 40. The actuator screw 60 can be moved within the through bore with a hex wrench (not shown), which has a hexagonal end that mates with the hexagonal internal geometry 626 of the first cavity 625. Turning the hex wrench causes the actuator screw 60 to move through the through bore 430 towards either end 42, 44 of the grip sleeve 40 until it is located at a desired location within the body 420 of the grip sleeve 40.

Once the actuator screw 60 is at a desired location, the shaft adapter 20, which preferably is permanently bonded to the shaft 30, is inserted through the receiving section 410 of the grip sleeve 40 so that the keyed extension 220 fits within the body 420 of the grip sleeve 40 and the tip portion 230 engages with the second cavity 635 of the actuator screw 60, as shown in FIG. 5. The shaft adapter 20, and thus the shaft 30, is semi-permanently fixed to the actuator screw 60 by screwing the screw 70 into the threaded bore 235 of the tip portion 230. The screw 70 can be accessed with a screwdriver via the opening 54 in the grip 50 and the through bore 430 of the grip sleeve 40. Fixing the actuator screw 60 to the shaft adapter 20 in this way serves to anchor the actuator screw 60 within the grip sleeve 40, as the shaft adapter 20 cannot rotate within the body 420 of the grip sleeve 40 due to the internal keyed geometry 422, and prevents the shaft adapter 20 from being removed from the grip sleeve 40 because the actuator screw 60 cannot turn or move within the grip sleeve 40.

If a user is not satisfied with the overall length $L_1$ of the variable length shaft and grip system 10 described herein after fixing the actuator screw 60 to the shaft adapter 20, he or she can simply unscrew the screw 70 from the tip portion 230 of the shaft adapter 20, move the actuator screw 60 to a new location within the grip sleeve 40 with the hex wrench or other tool, and then reattach the actuator screw 60 to the shaft adapter 20 with the screw 70. The length $L_2$ of the keyed extension 220 of the shaft adapter 20 determines the overall length adjustability of the variable length shaft and grip system 10 disclosed herein, as the first ledge 216 on the raised ring 215 of the shaft adapter 20 abuts the second, interior ledge 416 of the grip sleeve 40 when the keyed extension 220 is fully disposed within the body 420 of the grip sleeve 40 and prevents the base 210 of the shaft adapter 20 from being inserted into the body 420 of the grip sleeve 40.

Preferably, the threaded internal surface 426 of the grip sleeve 40 does not extend along the entire length of the body 420, with a gap 425 having a length $L_3$ located between the second, interior ledge 416 and the threads of the threaded internal surface 426. The receiving section 410 of the grip sleeve 40 preferably has a length $L_4$ that, when added to the length $L_3$ of the gap, is equivalent to the length $L_5$ of the tip portion 230 and keyed extension 220 of the shaft adapter 20, so that when the variable length shaft and grip system 10 is at its most extended configuration, with the actuator screw 60 located at the second end 44—most point of the threaded internal surface 426, the shaft adapter 20 is completely hidden within the grip sleeve 40 and only the grip 50, grip sleeve 40, and shaft 30 are visible, as shown in FIGS. 1 and 2.

The disclosure of each of U.S. patent application Ser. Nos. 13/286,791 and 13/544,536 is hereby incorporated by reference in its entirety herein. The disclosure of each of U.S. Patent Application Publication Numbers 20120149486, 20120149487, 20120149488, 20120149489, and 20120184389 is also hereby incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A shaft assembly comprising:

a shaft;

a shaft adapter comprising an adapter portion and an actuator screw portion; and a grip sleeve, wherein the actuator screw portion is releasably attached to the adapter portion, wherein the adapter portion comprises a first keyed structure, wherein the grip sleeve comprises a threaded internal surface and a second keyed structure, wherein the actuator screw portion comprises a threaded external surface sized to engage with the threaded internal surface of the grip sleeve, wherein the shaft adapter is affixed to the shaft, and wherein the first keyed structure mates with the second keyed structure to prevent the shaft adapter from rotating when the adapter portion is inserted into the grip sleeve.

2. The shaft assembly of claim 1, further comprising a mechanical fastener, wherein attaching the actuator screw portion to the adapter portion with the mechanical fastener fixes the shaft adapter to the grip sleeve.

3. The shaft assembly of claim 2 wherein the mechanical fastener is a screw comprising a head and a threaded extension, and wherein the screw reversibly fixes the shaft adapter to the grip sleeve.

4. The shaft assembly of claim 3, further comprising a retention o-ring, wherein the actuator screw portion comprises a flange having a through bore, wherein the threaded extension of the screw is disposed within the through bore, and wherein the retention o-ring prevents the screw from disengaging from the actuator screw.

5. The shaft assembly of claim 1, wherein the shaft comprises an external surface having a plurality of length markings.

6. The shaft assembly of claim 1, wherein the shaft adapter is permanently affixed to the shaft.

7. The shaft assembly of claim 1, wherein the shaft assembly can increase and decrease in length by at least 0.50 inch.

8. The shaft assembly of claim 1, wherein the grip sleeve, the shaft adapter, and the shaft are composed of a composite material and wherein the actuator screw is composed of a plastic material.

9. The shaft assembly of claim 1, further comprising a grip composed of a polymeric material, wherein the grip is disposed over the grip sleeve.

10. The shaft assembly of claim 9, wherein the grip is composed of a rubber material.

11. The shaft assembly of claim 9, wherein the grip is permanently affixed to the grip sleeve with an adhesive.

12. A shaft assembly comprising:

a shaft;

a shaft adapter comprising an adapter portion and an actuator screw portion;

a grip sleeve; and a screw comprising a head and a threaded extension, wherein the actuator screw portion is releasably attached to the adapter portion, wherein the grip sleeve comprises a threaded internal surface, wherein the actuator screw portion comprises a threaded external surface sized to engage with the threaded internal surface of the grip sleeve, wherein the shaft adapter is affixed to the shaft, wherein attaching the actuator screw portion to the adapter portion with the screw reversibly fixes the shaft adapter to the grip sleeve and wherein the shaft adapter is permanently affixed to the shaft.

13. The shaft assembly of claim 12, further comprising a retention o-ring, wherein the actuator screw portion comprises a flange having a through bore, wherein the threaded extension of the screw is disposed within the through bore, and wherein the retention o-ring prevents the screw from disengaging from the actuator screw.

14. The shaft assembly of claim 12, wherein the shaft comprises an external surface having a plurality of length markings.

15. The shaft assembly of claim 12, wherein the shaft assembly can increase and decrease in length by at least 0.50 inch.

16. The shaft assembly of claim 12, wherein the grip sleeve, the shaft adapter, and the shaft are composed of a composite material, wherein the actuator screw is composed of a plastic material, and wherein the screw is composed of a metal alloy material.

17. The shaft assembly of claim 12, further comprising a grip composed of a polymeric material.

18. The shaft assembly of claim 17, wherein the grip is disposed over the grip sleeve.

19. The shaft assembly of claim 18, wherein the grip is permanently affixed to the grip sleeve with an adhesive.

* * * * *